US006911137B2

(12) United States Patent
Van Der Weijde

(10) Patent No.: US 6,911,137 B2
(45) Date of Patent: Jun. 28, 2005

(54) METHOD AND DEVICE FOR THE ELECTROLYTIC COATING OF A METAL STRIP

(75) Inventor: Dammes Hans Van Der Weijde, Woerden (NL)

(73) Assignee: Corus Technology BV, Ijmuiden (NL)

( * ) Notice: Subject to any disclaimer, the term of this patent is extended or adjusted under 35 U.S.C. 154(b) by 152 days.

(21) Appl. No.: 10/258,443

(22) PCT Filed: Apr. 26, 2001

(86) PCT No.: PCT/NL01/00352

§ 371 (c)(1),
(2), (4) Date: Jan. 16, 2003

(87) PCT Pub. No.: WO01/83857

PCT Pub. Date: Nov. 8, 2001

(65) Prior Publication Data

US 2004/0074776 A1 Apr. 22, 2004

(30) Foreign Application Priority Data

Apr. 28, 2000 (NL) ..... 1015054

(51) Int. Cl.[7] ..... C25D 7/06; C25D 5/34
(52) U.S. Cl. ..... 205/138; 205/206
(58) Field of Search ..... 205/138, 206

(56) References Cited

U.S. PATENT DOCUMENTS 3,855,108 A * 12/1974 Boiz et al. ..... 204/206

FOREIGN PATENT DOCUMENTS

JP 06264288 9/1994

* cited by examiner

*Primary Examiner*—Edna Wong
(74) *Attorney, Agent, or Firm*—Stevens, Davis, Miller & Mosher, LLP

(57) ABSTRACT

Method for the electrolytic coating of a metal strip, in which the strip forms a cathode and is moved in its longitudinal direction relative to an anode, an electrolyte flowing at least between the strip and the anode, characterized in that the flow of the electrolyte is influenced by holding a body between the strip and the anode. A device for the electrolytic coating of a metal strip is also enclosed.

19 Claims, 7 Drawing Sheets

METHOD AND DEVICE FOR THE ELECTROLYTIC COATING OF A METAL STRIP

FIELD OF THE INVENTION

The invention relates firstly to a method for electrolytically coating of a metal strip, in which the strip forms a cathode and is moved in its longitudinal direction relative to an anode, an electrolyte flowing at least between the strip and the anode.

BACKGROUND OF THE INVENTION

A method of this type is generally known. In the known method, the distance between the metal strip and the anode is usually held at between 5 and 10 cm, while the strip which is to be coated, in the transverse direction in the vicinity of the anode, usually extends over a multiple (usually approximately 1 m) of this distance, with the result that a relatively narrow clearance is formed between the metal strip and the anode. A potential difference is applied between the anode and the cathode, leading to an electric current flowing through the electrolyte. In a method in which soluble anodes are used, the electric current leads to the dissolution of material, usually one or more metallic elements, from an anode, on the one hand, and the precipitation of the said material in a layer on the strip, on the other hand.

It is usually aimed to apply the layer at the highest possible speed. The rate at which the layer grows is dependent, inter alia, on the electric current density and on the velocity at which the strip is moved through the electrolyte. However, the electric current density affects not only the growth rate of the layer but also its morphology. Since undesirable dendrites are formed above a set threshold, the maximum current density is in practice limited.

The velocity of the strip is also limited in practice. If the strip velocity were too high, given a specific, more or less limited growth rate, the coating line would become too long for a specific desired layer thickness to be reached.

It is known to use special jets on either side of the strip to spray the electrolyte into the clearance between the strip and the anode substantially in the transverse direction with respect to the direction of movement of the strip. In this way, the flow velocity of the electrolyte through the clearance is increased.

One drawback of the known method is that the flow of the electrolyte in the clearance is not sufficiently uniform, with the result that the morphology and thickness of the deposited layer are not sufficiently uniform. Yet another drawback is that the known jets are complicated and are expensive to maintain and operate.

SUMMARY OF THE INVENTION

It is an object of the invention to provide a method with which the abovementioned drawbacks are eliminated or reduced. Another object of the invention is to be able to increase the running velocity of the strip, while the thickness of the layer which is deposited per unit length in a coating line can remain at least equal. Yet another object is to increase the efficiency of electrolysis on the strip. Yet another object is to provide a less expensive method for the electrolytic coating of a metal strip. Yet another object is to provide a method for electrolysis in which less waste material is produced.

One or more of these objects is achieved with a method of the type described in the first paragraph of this description in which the flow of the electrolyte is influenced by holding a body between the strip and the anode. In this way, the diffusion boundary layer in the electrolyte in the vicinity of the moving strip is influenced, with the result that the precipitation of anode material on the strip can proceed more efficiently and/or more homogeneously. A reduction in the thickness of the boundary layer, in particular, leads to an increased rate of deposition of material, so that the velocity at which the strip is moved through the coating line can be increased.

By holding the body in the clearance between the strip and the anode, it is possible to influence the flow of the electrolyte more uniformly than has previously been the case. According to the invention, it has been found that holding a body which is not excessively shielding in the clearance has little if any adverse effect on the required potential difference and on the uniformity of electric current distribution in the electrolyte in the vicinity of the strip.

The use of the invention provides additional advantages for certain processes in which, for example, a cyanide-containing electrolyte is used. In a process of this type, the anode efficiency is usually 100%. Since the cathode efficiency is usually lower than 100%, a fraction of the exposed anode surface which corresponds to the cathode efficiency usually consists of a non-soluble (inert) metal, in order to keep the quantity of anode material in the electrolyte constant. However, the electrolyte breaks down at this non-soluble fraction of the anode, forming waste material. For example, a carbonate is formed from the cyanide, and this carbonate has to be constantly removed from the electrolyte and disposed of as chemical waste. On the one hand, this entails removal costs, and on the other hand raw material costs are also involved. The invention allows the efficiency at the cathode to be increased, and consequently the drawbacks associated with the inert fraction are reduced proportionally.

Preferably, at least that section of the body which is held between the strip and the anode is electrically insulating. This prevents the electrolysis process from being disrupted by electrochemical activity of the body which is held between the anode and the cathode.

Preferably, the flow of the electrolyte is influenced in such a manner that, at a certain distance from the strip, the mean velocity of the electrolyte, in the longitudinal direction of the strip, with respect to the strip is higher than the velocity of the strip with respect to the anode. This is achieved by influencing the flow in such a manner that the direction of flow of the electrolyte is as far as possible opposite to the direction of movement of the strip. Since the relative velocity of the strip passing through the electrolyte is higher, the boundary layer is thinner, and the precipitation of material proceeds more successfully and more quickly.

Preferably, the body is moved. In this way, it is possible to influence the flow of the electrolyte more effectively without, in the process, requiring jets on either side of the strip. It is possible to influence both laminar and turbulent flows and also to convert a laminar flow into a turbulent flow. In all cases, the diffusion boundary layer can become thinner, which improves the mass transfer.

One embodiment of the method according to the invention is characterized in that the body, for example a perforated strip, is moved substantially parallel to the strip, in the opposite direction. The oppositely directed movement of the body leads to a flow which is directed oppositely to the direction of movement of the strip being at least partially imposed in the electrolyte. One advantage of this embodiment is that the distribution of the electric current density through the electrolyte is not stationary, so that, on the one hand, a (usually stationary) anode is dissolved more homogeneously and, on the other hand, the layer is deposited more homogeneously on the metal strip.

Another embodiment of the method according to the invention is characterized in that the body is moved in rotation about an axis, which axis runs substantially parallel to the strip and substantially perpendicular to the longitudinal direction of the strip. Given the correct direction of rotation, it is ensured that the electrolyte is pumped around substantially in the opposite direction to the direction of movement of the strip, with the result that the said relative strip velocity is increased.

In this embodiment, the body is preferably rotated about its longitudinal axis. This ensures that the electrolyte is pumped around substantially in the opposite direction to the direction of movement of the strip, while the conditions under which the electrolysis is carried out fluctuate as little as possible.

The invention is also embodied by a device for the electrolytic coating of a metal strip, comprising a housing for holding an electrolyte, an anode, means for using the strip as a cathode, and means for advancing the strip in its longitudinal direction, via a path, at a specific distance relative to the anode.

According to this aspect of the invention, the device is characterized in that the device furthermore comprises a body which is to be held, at least over a section thereof, in the electrolyte between the anode and the path. During operation, the body influences the flow of the electrolyte, with the result that the mass transfer is improved and material can be deposited more quickly on the strip. It has been found that a body which is not excessively shielding in the clearance has little if any adverse effect on the potential difference between the anode and the strip required during operation and on the uniformity of the electric current distribution of the electrolyte on the strip.

Preferably, at least that section of the body which is to be held between the anode and the path is electrically insulating. This prevents the bodies which are to be held between the anode and the path from being electrochemically active.

The path in which the metal strip is to be moved past the anode comprises an active area, where the strip is coated during operation, and also comprises an open area, which open area is free of an imaginary shadow formed by a perpendicular projection of a body which, during operation, at least over a section thereof, is situated between the anode and the path. Preferably, the open surface comprises more than 60% of the active area of the path. It has been found that under this condition the body does not shield the anode excessively from the path, with the result that the current density distribution and the required potential difference in the customary electrolysis processes are not adversely affected or are only slightly adversely affected as a result of the body, if this condition is complied with.

Preferably, the body extends parallel to the path. This ensures that the flow of the electrolyte, during operation, is influenced as homogeneously as possible along the path.

The device preferably comprises means for moving the body. In this way, it is possible to influence the flow of the electrolyte more effectively, without requiring jets on either side of the strip.

In one embodiment of the device according to the invention, the body comprises a perforated strip. In this way, the flow of the electrolyte is influenced homogeneously over the entire active area of the path. The perforation serves to create a passage for the material of the anode and the electric current. When the strip is moved in the opposite direction to the direction of movement of the metal strip which is to be coated, the electrolyte will also be moved with the strip, and the velocity of the strip with respect to the electrolyte will be increased as a result. A further advantage of a perforated strip is that the distribution of the electric current density does not remain stationary while the device is operating, with the result that the anode is dissolved more uniformly.

In another embodiment, the device comprises two or more bodies which are to be held at least in the electrolyte between the anode and the path. This once again results in homogeneous influencing of the flow of the electrolyte. If desired, the bodies can rotate about an axis which is parallel to the path and is oriented in the transverse direction of the direction of movement of the strip in the path. This embodiment is relatively easy to incorporate in an existing device.

Preferably, the distance from the bodies to the path is identical for each of the bodies. The result is a more uniform coating.

BRIEF DESCRIPTION OF THE DRAWINGS

The invention will now be explained with reference to an exemplary embodiment of the method and device according to the invention, with reference to the drawing, in which.

DETAILED DESCRIPTION OF THE PREFERRED EMBODIMENTS

Figure 1:
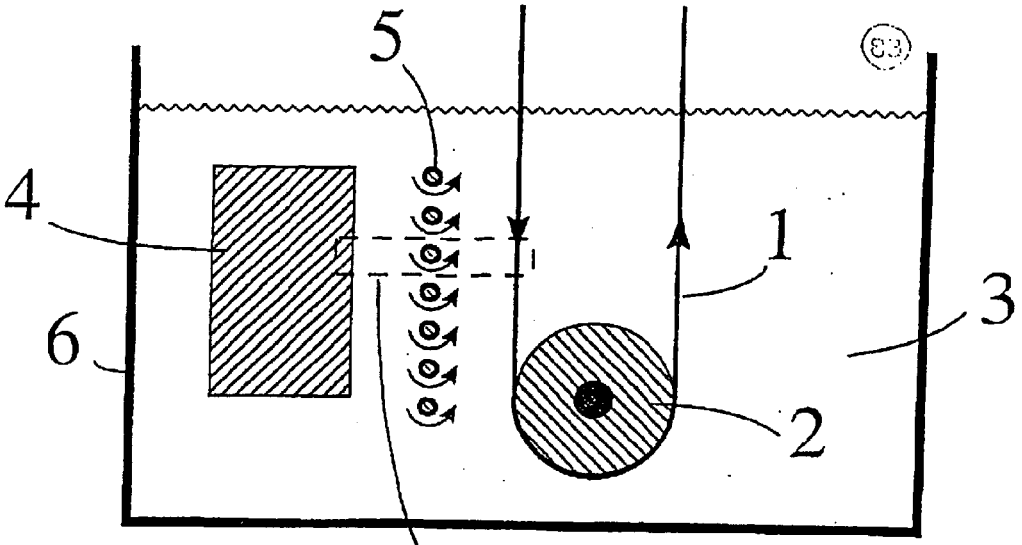
FIG. 1 shows a diagrammatic cross section through an exemplary embodiment of the device according to the invention.

FIG. 1 shows a device for coating a metal strip with the aid of electrolysis, including a housing 6, a metal strip 1, an anode 4 and means for advancing the strip in its longitudinal direction, in the direction of the arrow, via a path at a certain distance from the anode, for example a conveyor roller 2. The housing 6 is filled with an electrolyte 3. Metal strip 1 is used as cathode. A potential difference is applied between metal strip 1 and anode 4, with the result that an electric current passes between the anode and the cathode, and electrolysis can take place. During electrolysis, material is deposited on the metal strip, so that it is coated with a layer.

According to the invention, the device also comprises a body 5 at least partially between the anode and the path of the metal strip. In the embodiment as shown in FIG. 1, there are a number of rod-like bodies 5 at equal distances from the metal strip. The rod-like bodies 5 can rotate in the direction of the arrows. Rotation of the bodies causes the flow of electrolyte to be influenced. In this way, the boundary layer which is situated in the electrolyte in the vicinity of the moving strip is influenced in such a manner that the deposition of material on the strip proceeds more successfully.

Usually, the mass transfer of deposition on a long flat strip, at a specific current density, is virtually proportional (the logarithm of proportionality is approximately 0.9) to the velocity at which the strip is moved through the electrolyte. By influencing the flow of electrolyte in such a manner that the relative velocity of the strip with respect to the electrolyte increases, the mass transfer at the metal strip can increase.

Figure 2:
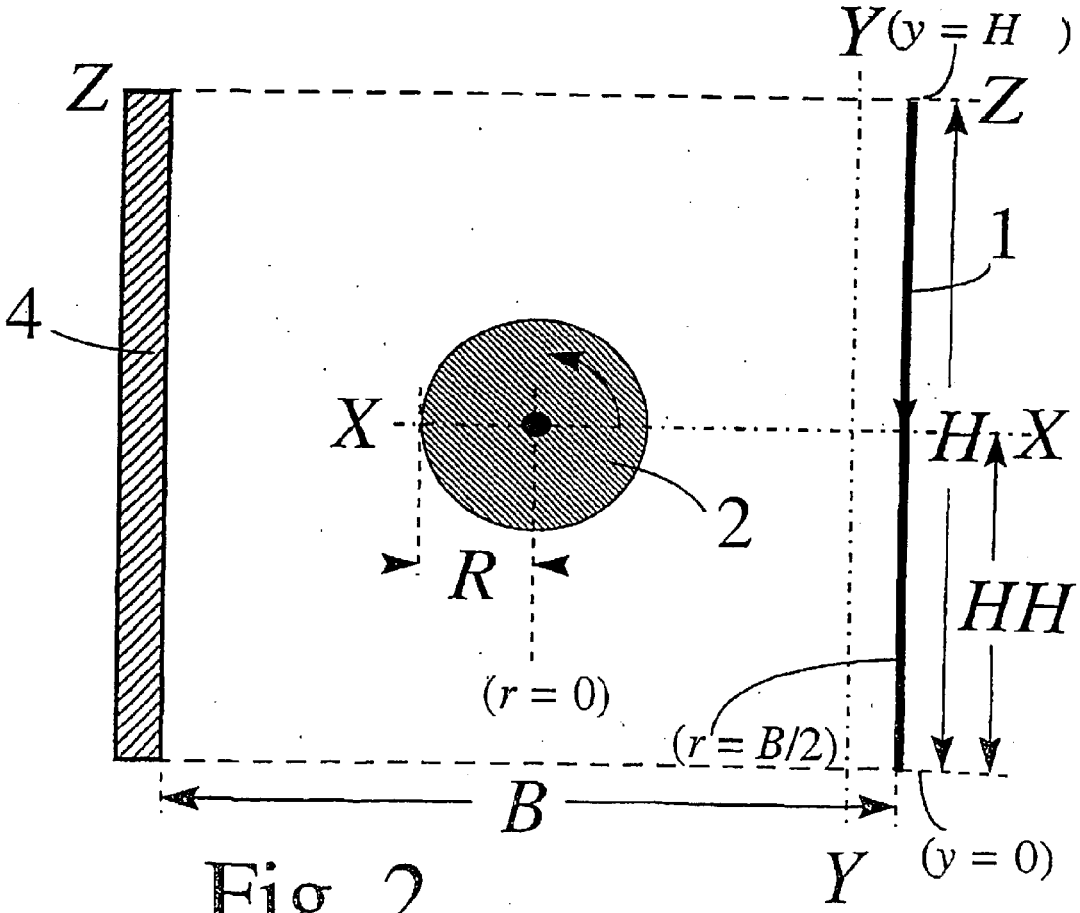
FIG. 2 shows an enlarged excerpt from FIG. 1.

In FIG. 1, the box A indicates the section of the device which is illustrated on an enlarged scale in FIG. 2. The reference numbering used in FIG. 2 corresponds to the reference numbering used in FIG. 1. On the basis of the geometry shown in FIG. 2, a study of the distribution of the flow velocities of the electrolyte as a result of a regular row of cylinders which are positioned parallel to the metal strip and rotate about their longitudinal axis was carried out. For this study, the parameters selected were a cell width B of 10 cm, a cell height H of 10 cm, in the centre of which a cylindrical body 2, which has a radius R=1.5 cm, is spaced from the metal strip 1 and anode 4 and rotates at a specific frequency. The study was carried out with the aid of numeric CFX calculations, using periodic boundary conditions so that the effect of adjacent bodies is also included in the study.

Figure 3:
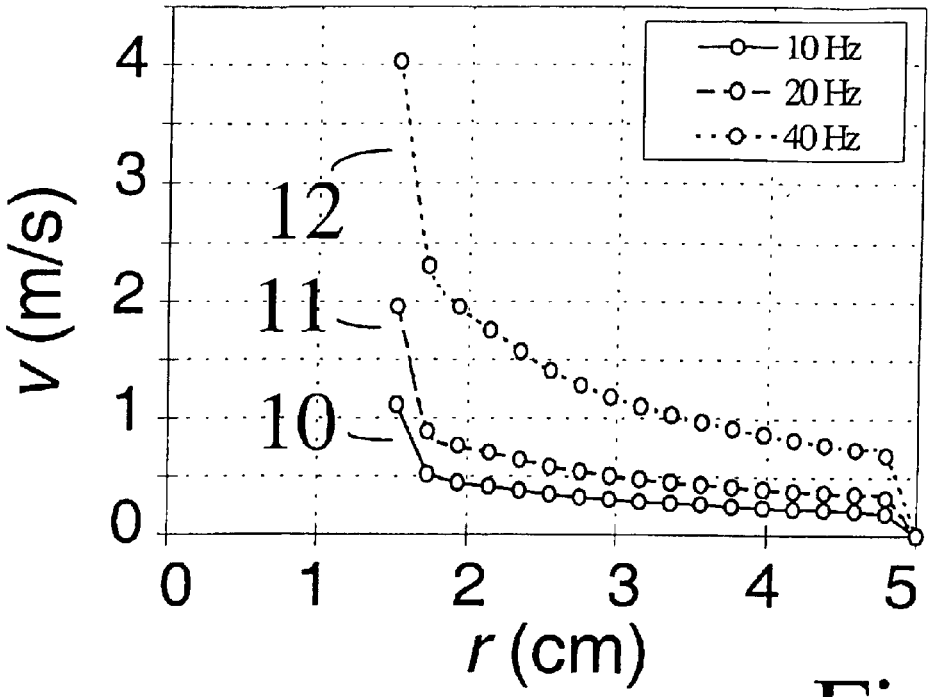
FIG. 3 shows, for various rotational frequencies of the body in a simulation unit such as that shown in FIG. 2, the flow velocity of the electrolyte as a function of the distance from the axis of rotation of the body.

FIG. 3 shows the flow velocity v of the electrolyte in metres per second as a function of the distance r on line X—X from the axis of rotation of the body 2, with the strip 1 being stationary. Line 10 shows the flow velocity as a result of the body being rotated about its longitudinal axis at a rotational frequency of 10 Hz. At this rotational frequency, the velocity of the cylinder surface is 0.94 m/s. It will be clear that when the body rotates the electrolyte is set in motion. Within a few millimetres of the cylinder surface, the velocity of the electrolyte has halved. There then follows a range in which the flow velocity decreases at approximately $1/r+1/(B-r)$, which corresponds to a potential approximation of two bodies with mirror symmetry in the plane of the strip. Finally, a thin boundary layer is formed close to the strip 1, in which boundary layer the flow velocity of the electrolyte is adapted to the velocity of the strip (which in this case is stationary). The formation of this boundary layer is beneficial to the mass transfer.

The fact that this also improves the cathode efficiency is illustrated on the basis of an experiment in which the efficiency at a cylindrical cathode with a diameter of 1.2 cm was systematically determined by making this cathode rotate at different rotational frequencies Ω of between 1 and 26.8 Hz in a cyanide bath with a composition of 112.8 g/l of CuCN (80 g/l of Cu)+135.4 g/l of NaCN+80 g/l of $Na_2CO_3$, during copper electrolysis with a current density of 500 $Am^{-2}$. The cathode efficiency is determined by anodically (at an anode efficiency of 100%) re-dissolving the copper which has precipitated on the cathode surface within a set time, a noticeable change in the voltage drop indicating the moment at which all the copper has disappeared from the surface. It is known that the mass transfer with a rotating cathode of this nature is proportional to a 0.7 power of the frequency. Therefore, in FIG. 4 the cathode efficiency, CE, is plotted against $\Omega^{0.07}$. It can be seen from FIG. 4 that at a bath temperature of 70° C. the cathode efficiency at the cylinder at 1 Hz rotation is approximately 75%, and increases proportionally to $\Omega^{0.7}$ up to a maximum of approximately 93%. The efficiency does not increase further if the rotational frequency is increased further than approximately $\Omega^{0.7}\approx 5$ per Hz.

Figure 4:
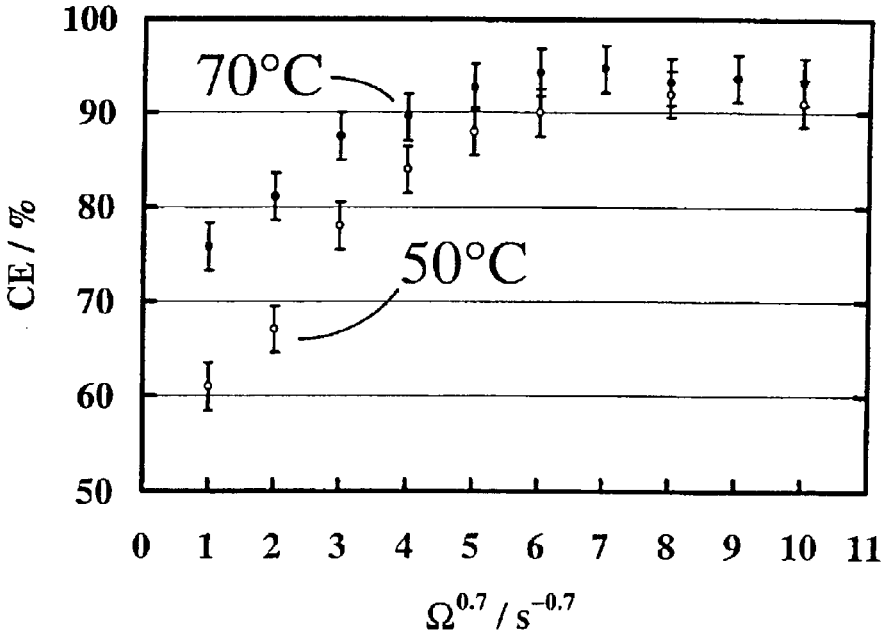
FIG. 4 shows the experimentally determined cathode efficiency on a rotating cylindrical cathode during electrolytic coating with copper in a cyanide bath.

FIG. 4 shows that improvement in the mass transfer (reduction in the size of the boundary layer) increases the cathode efficiency noticeably. Assuming that the mass transfer, in the case of a flat cathode, improves directly proportionally to the velocity of the strip passing through the electrolyte, an increase in the relative velocity of the strip by a factor of 5 is sufficient to raise the cathode efficiency from 75% to 93%.

FIG. 3 also shows the line 11 which represents the velocity profile which was found for a rotational frequency of 20 Hz, and the line 12 shows the velocity profile for the rotational frequency of 40 Hz. The mean flow velocities of the electrolyte which are derived from FIG. 3 and are caused by the rotating bodies are shown in the following table:

| Corresponding line number in FIG. 3 | Rotational frequency of the body (Hz) | Mean flow velocity on line X-X (m/s) |
|---|---|---|
| 10 | 10 | 0.35 |
| 11 | 20 | 0.60 |
| 12 | 40 | 1.37 |

At a flow velocity of 0.34 m/s, the required factor of 5 in mass transfer in order to provide the maximum improvement in cathode efficiency with a constant strip velocity, is achieved in this example at 40 Hz.

The study has also shown that the mean flow velocity of the electrolyte increases by approximately the third power with the radius of a cylindrical body. If desired, this fact is also used in the design of a device for electrolysis.

Figure 5:
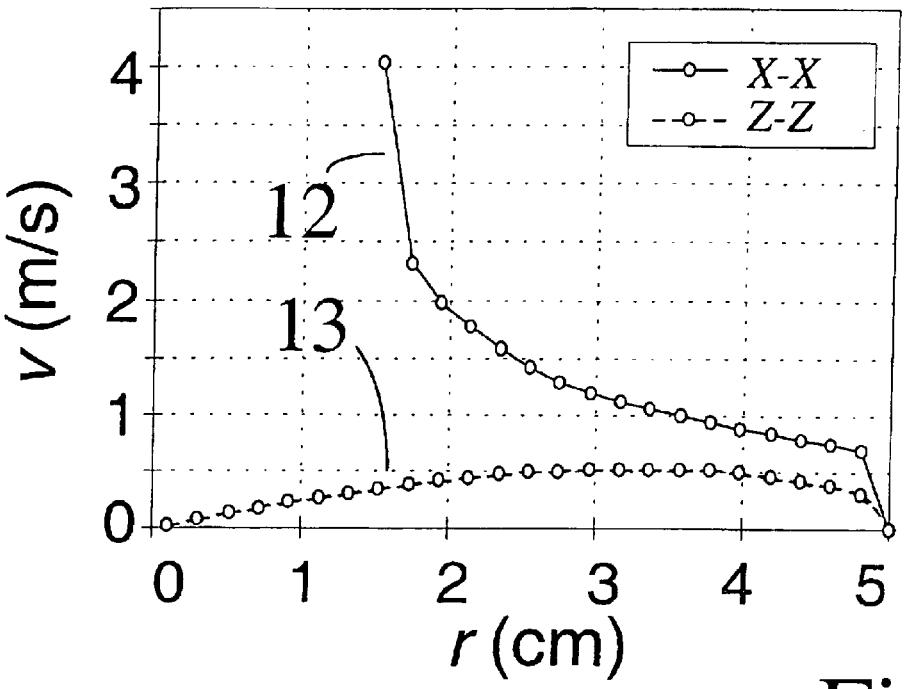
FIG. 5 shows the flow velocity of the electrolyte at different locations in the cell, in the simulation unit shown in FIG. 2.
Figure 6:
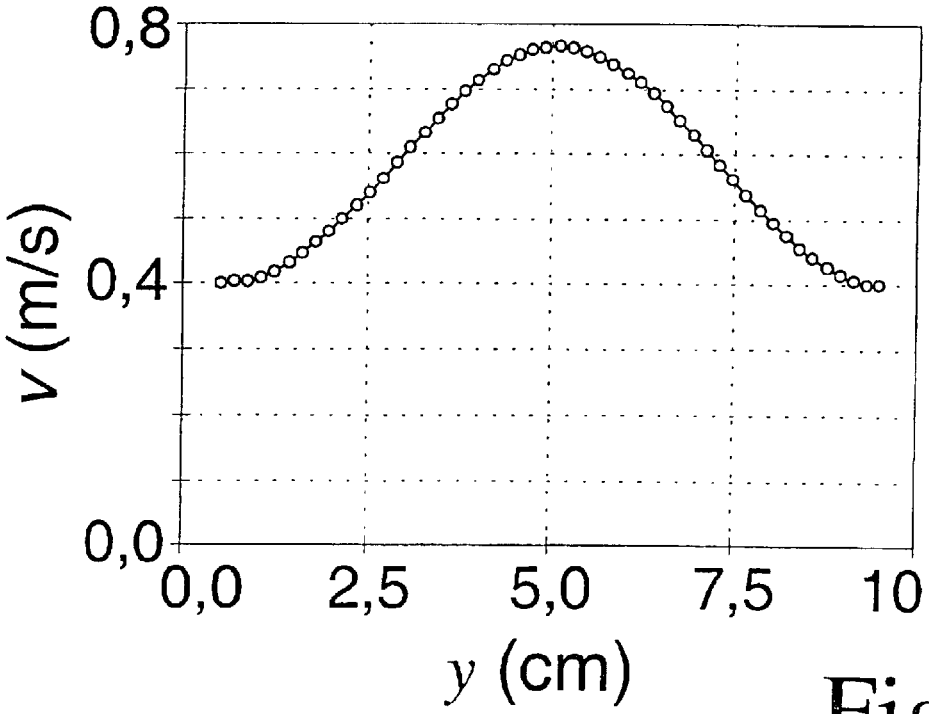
FIG. 6 shows the flow velocity of the electrolyte past the strip at a line which lies 0.5 cm away from the strip, in the simulation unit shown in FIG. 2.

In FIG. 5, line 12 once again shows the profile, on line X—X, of the flow velocity v of the electrolyte as a result of a body rotating at 40 Hz. Line 13 in FIG. 5 represents the local velocity of the electrolyte on line Z—Z. Over the entire width of the cell, the velocity on line Z—Z is lower than the velocity on line X—X. FIG. 6 shows the velocity as a function of the position y on an axis Y—Y which runs parallel to the metal strip at a distance of 4.5 cm from the axis of rotation (0.5 cm distance from the metal strip). The value y=5.0 cm corresponds to the intersection of line Y—Y and line X—X. It can be seen from the figure that the expected mass transfer behind the rotating bodies is higher by approximately a factor of 2 than the mass transfer in the centre between two adjacent rotating bodies.

Figure 7:
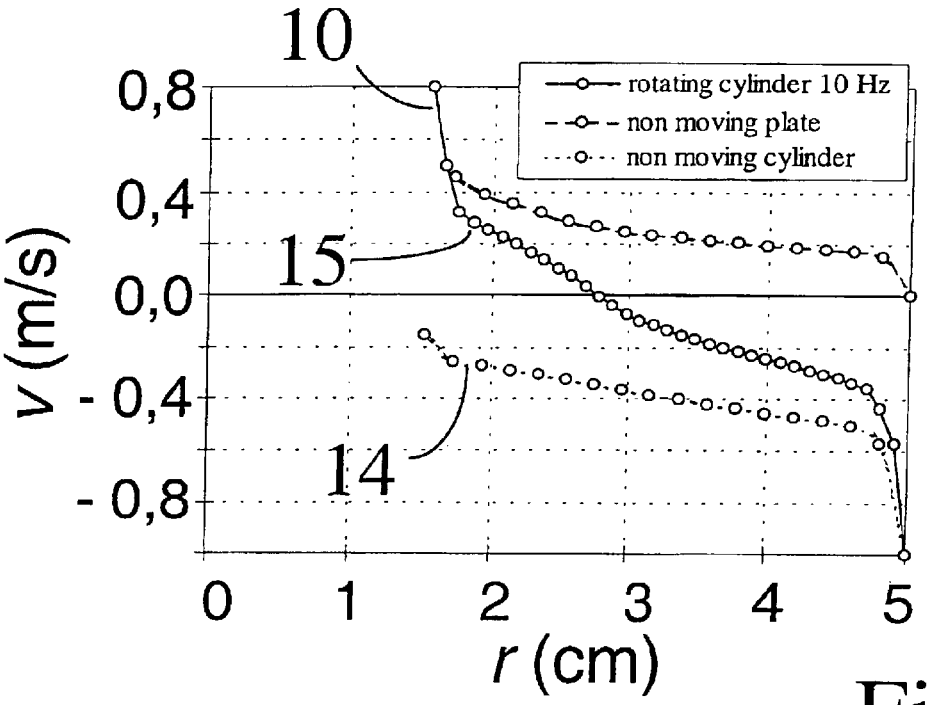
FIG. 7 shows the flow velocity of the electrolyte as a function of the distance from the axis of rotation of the body with a stationary and moving strip and with a stationary and rotating body, in the simulation unit shown in FIG. 2.

FIG. 7 shows a study which is comparable to that shown in FIG. 3, where line represents the flow velocity v of the electrolyte on line X—X with a stationary strip and a cylindrical body rotating at 10 Hz. Line 14 represents the velocity distribution on line X—X for the situation in which the body is not rotating and the strip is moved at 1.0 m/s in its longitudinal direction through the device. Apart from the boundary layer which is formed in the vicinity of the stationary body, this combination would correspond to the situation in which there is no body 5, as in the prior art. Finally, line 15 shows the effect of rotating the body at 10 Hz with a moving strip. It is clear that the boundary layer becomes thinner and the velocity gradient in the vicinity of the strip is higher when the body rotates. It will be understood that the velocity gradient increases still further at a high rotational frequency.

Since the cathode efficiency is increased, it is also possible to increase the velocity at which the strip is advanced. As a result, it is possible, using the same device and the same current density, to coat more metres of strip per unit time to the same layer thickness.

It can be seen from the above that the embodiment with rotating cylindrical bodies has a positive effect on the formation of a boundary layer in the vicinity of the surface of the metal strip which is to be coated. Naturally, it is possible to use variations, such as for examples bodies which are provided with blades, brushes or are formed in some other way in order to improve the transfer of motion to the electrolyte.

The text which follows will describe how the positioning of bodies influences the distribution of the electric current density through the electrolyte, and how the influence on homogeneity of precipitation of material on the strip can be minimized.

It is known that, with regard to an electric current density, above a certain threshold the morphology of the deposited layer is dominated by dendrites, resulting in a layer which has undesired properties. A maximum current density of between approximately 60 and 80% of this threshold is generally used, which in practice represents a current density of approximately 500 $Am^{-2}$. To be able to use a mean current density which is as high as possible, it is important for the distribution of the current density in the vicinity of the surface of the metal strip to be as even as possible.

The distribution of the current density also has to be kept as even as possible in particular when coating a metal strip with an alloy (such as for example Cu—Zn), since the composition of the alloy which is deposited is dependent on the current density. If the current density varies excessively, the composition of the layer is not sufficiently homogeneous. It is usually attempted to keep the current density of the electrolyte on the strip (i) relative to the mean current density ($i_{avg}$) within a range of $0.9<i/i_{avg}<1.1$.

Furthermore, the potential difference required should be kept as low as possible, in order to minimize dissipation. The voltage drop across the electrolyte which is deemed to be the maximum acceptable for, for example, the electrolytic coating of steel with copper is 7.0 V, while the desired value is between 5.0 and 5.5 V.

Figure 8:
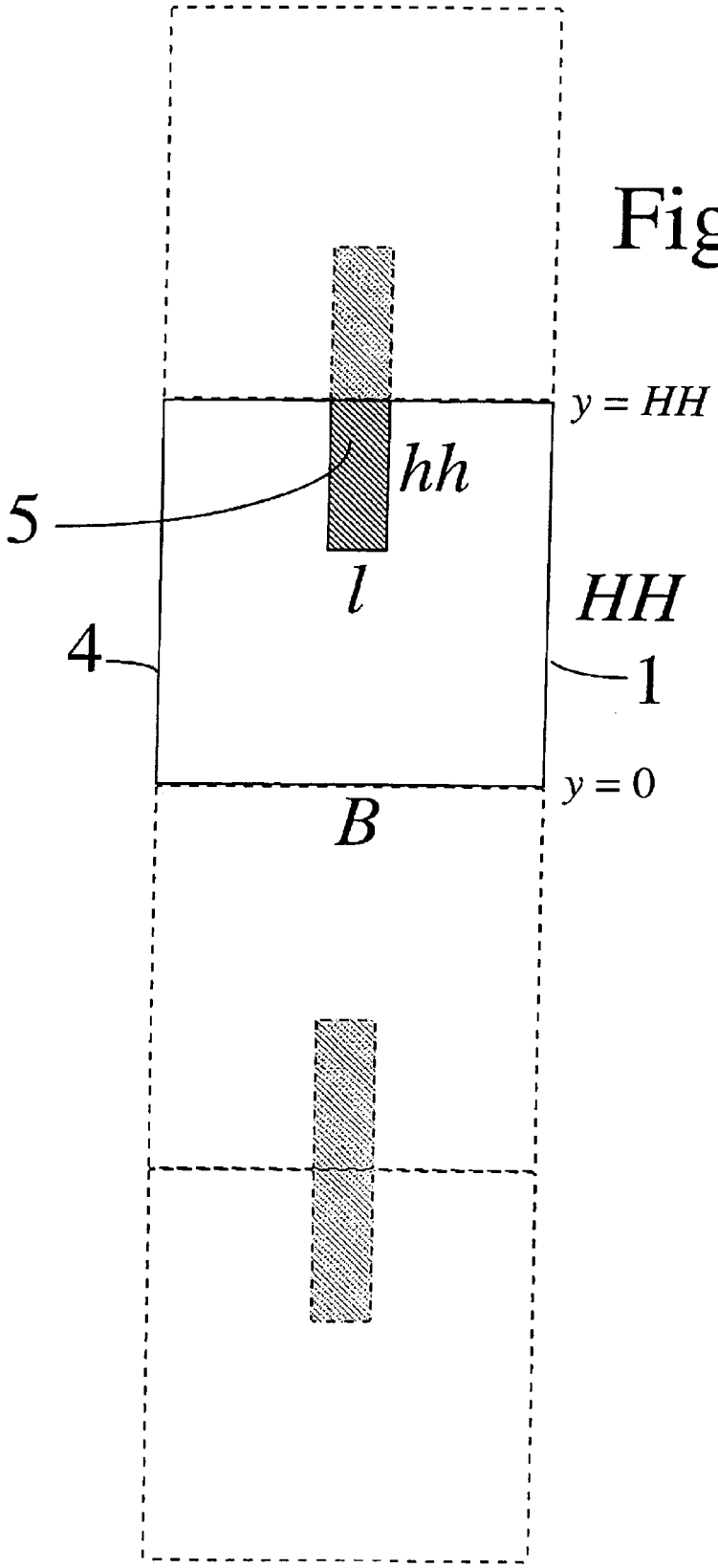
FIG. 8 diagrammatically depicts, in cross section, the geometry of a simulation unit which is used to calculate the electrical properties of the device.

The distribution of the electric current density at a location y on the path and the required potential difference can be calculated accurately. FIG. 8 shows, in cross section, the geometry of a simulation cell at which calculations of the electric current density were carried out using the method known as the boundary elements method. The calculations are based on Laplace's equation and Ohm's law. The calculations assume a series of rod-shaped bodies. The metal strip (cathode) is imagined to be on one of the vertical sides, with the anode on the opposite vertical side. From a repeating series of this type, a simulation cell was taken, as shown in FIG. 8. It is assumed that the cell is filled with a medium for which the conductivity is equal to $\kappa=10\ \Omega^{-1}m^{-1}$, which corresponds to the electrolytes which are customarily employed for the electrolytic coating of steel. Furthermore, a cell width of B=10 cm, a cell height of HH=10 cm, and a body of l=2.0 cm wide were selected. The half height, hh, of the body was varied in the calculations.

Figure 9:
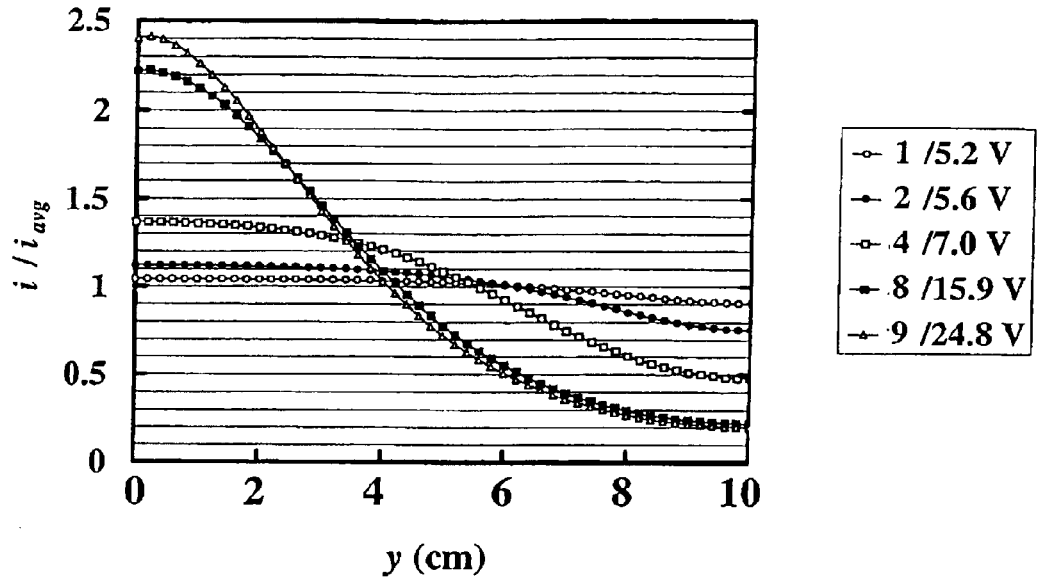
FIG. 9 shows the relative distribution of the electric current density through the electrolyte in the vicinity of the surface of the cathode, for various dimensions of the body.

FIG. 9 shows the distribution of the electric current density in the vicinity of the surface of the metal strip for various values of the half height hh of the body, varying from 1.0 to 9.0 cm inclusive, as a function of the position y on the strip in the simulation cell shown in FIG. 8. The various types of lines correspond to the legend, in which the associated values for hh (in cm) and the voltage drop across the electrolyte (in V) are given. The distribution of the current density is shown as the relative current density $i(y)/i_{avg}$ compared to the mean current density $i_{avg}$. It can be seen that the distribution of the current density becomes more even as the height of the body becomes smaller. If $i_{avg}$ is set at 70% of the threshold, the maximum current density, in the event of a deviation by a factor $i/i_{avg}<1.4$, still remains below the threshold. As shown in FIG. 9, this is the case for bodies for which the half height hh of the body is less than or equal to 4.0 cm. With bodies with a half height of 1.0 cm or less, the requirement of $0.9<i/i_{avg}<1.1$ is satisfied.

The voltage drop across the electrolyte associated with a mean current density of $i_{avg}=500\ Am^{-2}$ is also indicated in the legend to FIG. 9. With the selected $\kappa$ of $10\ \Omega^{-1}m^{-1}$ in a 10 cm wide cell which is filled only with electrolyte, the voltage drop at $i_{avg}=500\ Am^{-2}$ is 5.0 V. As can be seen from the figure, the presence of a body causes an increase in the voltage drop across the electrolyte. The higher the hh of the body, the higher the voltage drop. A body with a half height of hh=4.0 cm causes a voltage drop of 7.0 V and is therefore still acceptable.

Figure 10:
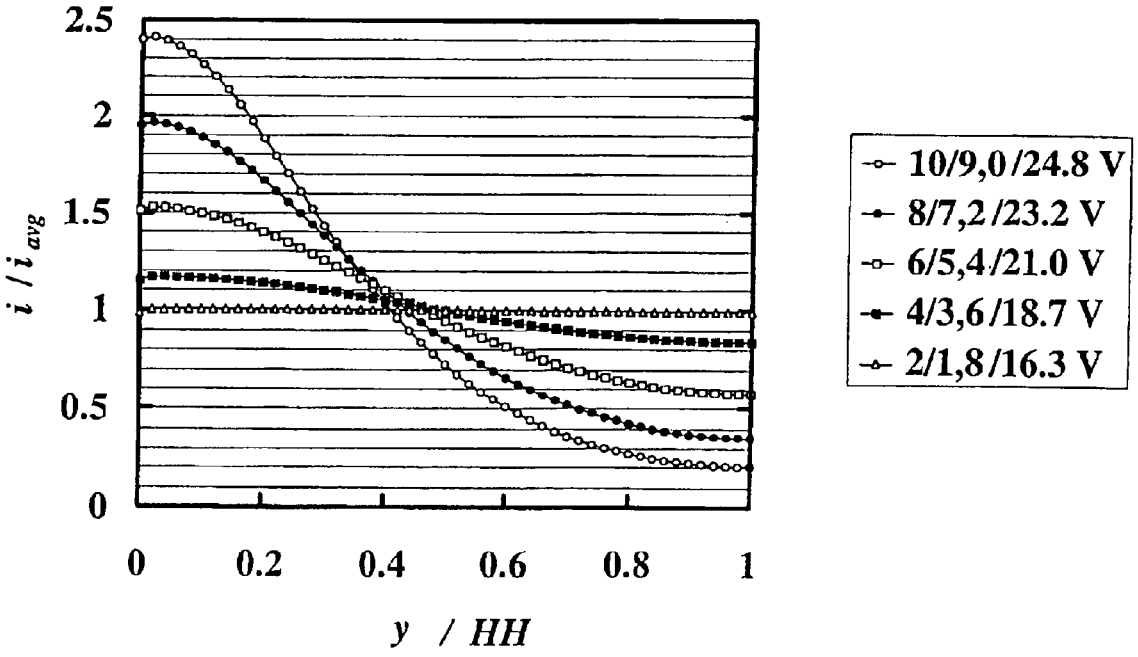
FIG. 10 shows the relative distribution of the electric current density through the electrolyte in the vicinity of the surface of the cathode, for various dimensions of the cell.

Both the distribution of the current density and the voltage drop across the electrolyte can be improved further by positioning a greater number of smaller bodies between the anode and the strip. FIG. 10 shows, for a number of simulation cells with a width of B=10 cm and with a body of l=2.0 cm wide, the current density distribution as a function of the position on the strip with respect to the height of the cell (y/HH), and the voltage drop, with the relative height of the body with respect to the height of the cell (hh/HH) being kept constant. The legend shows, for every curve, the associated HH, hh (both in cm), and the voltage drop across the electrolyte (in V). It can be seen that with an increasing number of smaller bodies the current density becomes more even and at the same time the voltage drop across the electrolyte becomes lower.

It is clear from FIG. 9 and FIG. 10 that under certain conditions the presence of a body between the anode and the strip does not have to unacceptably disrupt the current density and the potential difference required. In certain cases, the disruption is even negligible.

Figure 11:
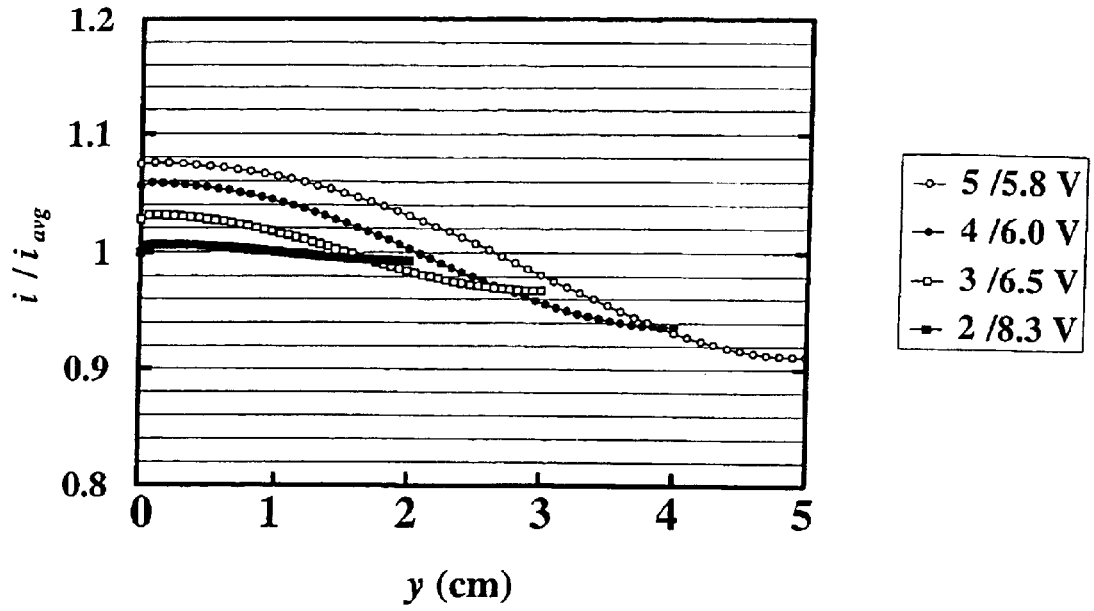
FIG. 11 shows the relative distribution of the electric current density through the electrolyte in the vicinity of the surface of the cathode in the embodiment of the invention as illustrated in FIG. 2, in which the body comprises a rotating cylindrical body.

FIG. 11 shows the distribution of the electric current density for a 10 cm wide cell, in which the same cylindrical body (with a radius of 1.5 cm) as that shown in FIG. 2 is held, for different cell heights HH ranging from 2.0 to 5.0 cm, as indicated in the legend. The situation in which HH=5.0 cm corresponds to the calculations from FIGS. 3, 5, 6 and 7. In this situation, the requirement of $0.9<i/i_{avg}<1.1$ is satisfied, and moreover the voltage drop across the electrolyte (at 500 $Am^{-2}$), as can be read off from the legend, is below 6.0 V. The variation in HH corresponds to reducing the distances between adjacent bodies. The distribution of the current density becomes more even as HH becomes smaller, to the detriment of the voltage drop.

It is possible for the diffusion boundary layer and the local variation in the current density to be adapted to one another. This takes place as follows. It can be seen from FIG. 6 that, for a certain geometry, the flow velocity of the electrolyte (and therefore also the expected mass transfer) behind the rotating bodies is higher by approximately a factor of 2 than in the centre between two adjacent rotating bodies. The velocity distribution over the strip can be made more even by reducing the distance between adjacent bodies. It can be seen from the study of the electric current density that the electric current density through the electrolyte just behind the bodies is lower than between the bodies. Consequently, with a uniform boundary layer, the growth rate of the layer behind the rotating bodies would in fact be lower. As has emerged from the study, the distribution of the electric current density can be varied independently of the distribution of the boundary layer. Since the two distributions have an opposite effect on the mass transfer in the vicinity of the surface of the strip, it is possible to design an optimum geometry in which the mass transfer across the strip becomes as homogeneous as possible.

The invention has been explained above on the basis of elongate rotating bodies, but the invention is not limited thereto. By way of example, an embodiment in which a perforated strip is moved, in the opposite direction to the movement of the strip to be coated, past the strip has already been offered in this application.

What is claimed is:

1. Method of electrolytically coating of a metal strip, in which the strip forms a cathode comprising the steps of:

moving the strip in its longitudinal direction relative to an anode, flowing an electrolyte at least between the strip and the anode, and holding a body between the strip and the anode, wherein the body is spaced from the strip, for influencing the flow of the electrolyte, wherein the body is moved.

2. Method according to claim 1, wherein at least that section of the body which is held between the strip and the anode is electrically insulating.

3. Method according to claim 1, wherein the flow is influenced in such a manner that, at a certain distance from the strip, the mean velocity of the electrolyte, in the longitudinal direction of the strip, with respect to the strip is higher than the velocity of the strip with respect to the anode.

4. Method according to claim 1, wherein the body is moved substantially parallel to the strip, in the opposite direction.

5. Method according to claim 1, wherein the body is moved in rotation about an axis, which axis runs substantially parallel to the strip and substantially perpendicular to the longitudinal direction of the strip.

6. Method according to claim 5, wherein the body is rotated about its longitudinal axis.

7. Method according to claim 1, further comprising at least one additional body, wherein two or more bodies, at least over a section of each body, are situated between the anode and the strip.

8. Method according to claim 7, wherein the distance from the bodies to the strip is identical for each of the bodies.

9. Method according to claim 1, wherein the body moves during said strip moving while the body is between the strip and the anode and the body is spaced from the strip and the anode for influencing the flow of the electrolyte.

10. Method according to claim 1, wherein the body is spaced from the strip and the anode during the holding step.

11. Device for electrolytically coating a metal strip, comprising:

a housing for holding an electrolyte, an anode, means for using the strip as a cathode, and means for advancing the strip in its longitudinal direction, via a path, at a specific distance relative to the anode, and a body held, at least over a section thereof, in the electrolyte between the anode and the path, wherein the body is spaced from the path, and means for moving the body.

12. Device according to claim 11, wherein at least that section of the body which is to be held between the anode and the path is electrically insulating.

13. Device according to claim 11, wherein the path comprises an active area, where the strip is coated during operation, and an open area, which open area, during operation, is free of an imaginary shadow formed by a perpendicular projection of the body which is situated between the anode and the path, the open area comprising more than 60% of the active area.

14. Device according to claim 11, wherein the body extends substantially parallel to the path.

15. Device according to claim 14, wherein the body comprises a perforated strip.

16. Device according to claim 11, further comprising at least one additional body, wherein two or more bodies, at least over a section of each body, are situated between the anode and the path.

17. Device according to claim 16, wherein the distance from the bodies to the path is identical for each of the bodies.

18. Device according to claim 11, wherein the means for moving the body comprises means for moving the body while the strip is moving along the path and the body is between the path and the anode and the body is spaced from the path and the anode for influencing the flow of the electrolyte.

19. Device according to claim 11, wherein the body between the anode and the path is spaced from the path and the anode.

* * * * *